US006954190B2

(12) United States Patent
Komiya

(10) Patent No.: US 6,954,190 B2
(45) **Date of Patent: *Oct. 11, 2005**

(54) ORGANIC EL CIRCUIT

(75) Inventor: Naoaki Komiya, Kobe (JP)

(73) Assignee: Sanyo Electric Co., Ltd. (JP)

( * ) Notice: Subject to any disclaimer, the term of this patent is extended or adjusted under 35 U.S.C. 154(b) by 119 days.

This patent is subject to a terminal disclaimer.

(21) Appl. No.: 10/062,651

(22) Filed: Jan. 31, 2002

(65) Prior Publication Data

US 2003/0030601 A1 Feb. 13, 2003

(30) Foreign Application Priority Data

Feb. 8, 2001 (JP) ..... 2001-032668

(51) Int. Cl.[7] ..... G09G 3/30; G09G 3/32
(52) U.S. Cl. ..... 345/76; 345/82
(58) Field of Search ..... 345/76, 82, 46, 345/83, 45, 89

(56) References Cited

U.S. PATENT DOCUMENTS 5,187,578 A 2/1993 Kohgami et al. ..... 348/687
6,429,601 B1 * 8/2002 Friend et al. ..... 315/169.3
6,518,941 B1 2/2003 Kimura ..... 345/55
6,556,176 B1 * 4/2003 Okuyama et al. ..... 345/76

FOREIGN PATENT DOCUMENTS

| | | |
|---|---|---|
| JP | 2720607 | 11/1997 |
| JP | 11-073158 | 3/1999 |
| KR | 10-0215590 | 5/1999 |

OTHER PUBLICATIONS

English translation of Office Action for Korean Patent Application No. 10–2002–0006971 dated Mar. 19, 2005.
Office Action for Korean Patent Application No. 10–2002–0006971 dated Feb. 27, 2004.

* cited by examiner

*Primary Examiner*—Xiao Wu
*Assistant Examiner*—Kevin M. Nguyen
(74) *Attorney, Agent, or Firm*—Cantor Colburn LLP

(57) ABSTRACT

Using scan (TFT 1-1~TFT 1-3) data having a size of 3 bits from data lines (DATA1~DATA3) is stored in storage capacitors (SC1~SC3). Driving TFTs (TFT 2-1~TFT 2-3) are switched fully on by the voltage of these storage capacitors (SC1~SC3). The on/off conditions of the driving TFTs (TFT 2-1~TFT 2-3) are controlled according to digital data, to control the on/off conditions of organic EL elements (EL1~EL3) and provide brightness control.

6 Claims, 6 Drawing Sheets

| DATA SIGNAL | GRAY SCALE LEVEL | 1 FRAME | | | |
|---|---|---|---|---|---|
| | | 1ST SUB FIELD | | 2ND SUB FIELD | |
| | | 1ST SUB-PIXEL | 2ND SUB-PIXEL | 1ST SUB-PIXEL | 2ND SUB-PIXEL |
| 0000 | 0 | ● | ●●●● | ●● | ●●●●●●●● |
| 0001 | 1 | ○ | ●●●● | ●● | ●●●●●●●● |
| 0010 | 2 | ● | ●●●● | ○○ | ●●●●●●●● |
| 0011 | 3 | ○ | ●●●● | ○○ | ●●●●●●●● |
| 0100 | 4 | ● | ○○○○ | ●● | ●●●●●●●● |
| 0101 | 5 | ○ | ○○○○ | ●● | ●●●●●●●● |
| 0110 | 6 | ● | ○○○○ | ○○ | ●●●●●●●● |
| 0111 | 7 | ○ | ○○○○ | ○○ | ●●●●●●●● |
| 1000 | 8 | ● | ●●●● | ●● | ○○○○○○○○ |
| 1001 | 9 | ○ | ●●●● | ●● | ○○○○○○○○ |
| 1010 | 10 | ● | ●●●● | ○○ | ○○○○○○○○ |
| 1011 | 11 | ○ | ●●●● | ○○ | ○○○○○○○○ |
| 1100 | 12 | ● | ○○○○ | ●● | ○○○○○○○○ |
| 1101 | 13 | ○ | ○○○○ | ●● | ○○○○○○○○ |
| 1110 | 14 | ● | ○○○○ | ○○ | ○○○○○○○○ |
| 1111 | 15 | ○ | ○○○○ | ○○ | ○○○○○○○○ |

Fig. 4

| DATA SIGNAL | GRAY SCALE LEVEL | 1 FRAME | | | |
|---|---|---|---|---|---|
| | | 1ST SUB FIELD | | 2ND SUB FIELD | |
| | | 1ST SUB-PIXEL | 2ND SUB-PIXEL | 1ST SUB-PIXEL | 2ND SUB-PIXEL |
| 0000 | 0 | ● | ●● | ●●●● | ●●●●●●●● |
| 0001 | 1 | ○ | ●● | ●●●● | ●●●●●●●● |
| 0010 | 2 | ● | ○○ | ●●●● | ●●●●●●●● |
| 0011 | 3 | ○ | ○○ | ●●●● | ●●●●●●●● |
| 0100 | 4 | ● | ●● | ○○○○ | ●●●●●●●● |
| 0101 | 5 | ○ | ●● | ○○○○ | ●●●●●●●● |
| 0110 | 6 | ● | ○○ | ○○○○ | ●●●●●●●● |
| 0111 | 7 | ○ | ○○ | ○○○○ | ●●●●●●●● |
| 1000 | 8 | ● | ●● | ●●●● | ○○○○○○○○ |
| 1001 | 9 | ○ | ●● | ●●●● | ○○○○○○○○ |
| 1010 | 10 | ● | ○○ | ●●●● | ○○○○○○○○ |
| 1011 | 11 | ○ | ○○ | ●●●● | ○○○○○○○○ |
| 1100 | 12 | ● | ●● | ○○○○ | ○○○○○○○○ |
| 1101 | 13 | ○ | ●● | ○○○○ | ○○○○○○○○ |
| 1110 | 14 | ● | ○○ | ○○○○ | ○○○○○○○○ |
| 1111 | 15 | ○ | ○○ | ○○○○ | ○○○○○○○○ |

Fig. 5

ORGANIC EL CIRCUIT

BACKGROUND OF THE INVENTION

1. Field of the Invention

The present invention relates to an organic EL circuit including, corresponding to each of a plurality of pixels, a plurality of driving transistors switched on and off in accordance data from a plurality of data lines and a plurality of EL elements corresponding to the plurality of driving transistors.

2. Description of the Related Art

Conventionally, use of an organic EL panel as a flat panel display is known. Because each pixel in an organic EL panel is self-emitting, an organic EL panel has advantages including that, unlike a liquid crystal display, no backlight is required and that the display is relatively bright.

FIG. 6 shows a structural example of a pixel circuit in a conventional organic El panel employing a thin film transistor (TFT). An organic EL panel is constructed by arranging elements such as these in a matrix form.

A gate line which extends in the row direction is connected to the gate of a scan TFT1 which is an n channel thin film transistor selected by the gate line. The drain of the scan TFT1 is connected to a data line which extends in the column direction, and the source of the scan TFT1 is connected to a storage capacitor SC, the other terminal of which is connected to a storage capacitance power source line VSC. The connection point between the source of the scan TFT1 and the storage capacitor SC is also connected to the gate of a driving TFT2 which is a p channel thin film transistor. The source of the driving TFT2 is connected to a power source PVDD and the drain of the driving TFT2 is connected to an organic EL element EL. The other terminal of the organic EL element EL is connected to a cathode power source VC.

When the gate line of the above circuit is at H level, the scan TFT1 is switched on, and the data in the data line at that point of time is stored in the storage capacitor SC. According to the data (electric potential) maintained in the storage capacitor SC, the driving TFT2 is switched on and off. When the driving TFT2 is switched on, an electric current flows through the organic EL element EL and light is emitted.

The data lines are sequentially switched on at a timing at which corresponding data is supplied to the video signal line. Therefore, the brightness of the organic EL element EL is controlled based on the video signal supplied to the data line. In other words, the gray scale display of each pixel is effected by controlling the gate potential of the driving TFT2, to control the electric current flowing through the organic EL element.

However, because there is an intrinsic difference in the threshold voltage (Vth) of the driving TFT2 for each pixel, the display of each pixel will not be equal, and, thus, the display will be uneven.

SUMMARY OF THE INVENTION

The present invention was conceived to address the above mentioned problem, and one object of the present invention is to provide an organic EL circuit which can perform desirable gray scale control such that display unevenness is not generated.

In order to achieve at least the object mentioned above, according to the present invention, a plurality of organic EL elements (sub-pixels) are provided in a pixel, the plurality of organic EL elements are switched on and off, and driving transistors of different size are provided. With such a structure, the gray scale can be controlled by switching the driving transistors fully on. Therefore, the effect of the threshold voltage of the driving transistor can be removed and a preferable gray scale control can be achieved.

According to another aspect of the present invention, the size of each of the driving transistors is varied in order to vary the amount of light emission by the EL element. With such structure, the gray scale can be controlled by switching appropriate driving transistors fully on. In this manner, the effect of the threshold voltage of the driving transistor can be removed.

According to another aspect of the present invention, it is possible to perform a finer gray scale control by incorporating time division light emission.

BRIEF DESCRIPTION OF THE DRAWINGS

FIG. 4 is a diagram showing one example of on/off condition for each sub-field.

FIG. 5 is a diagram showing another example of on/off condition for each sub-field.

DESCRIPTION OF PREFERRED EMBODIMENT

A preferred embodiment of the present invention will now be described referring to the figures.

Figure 1:
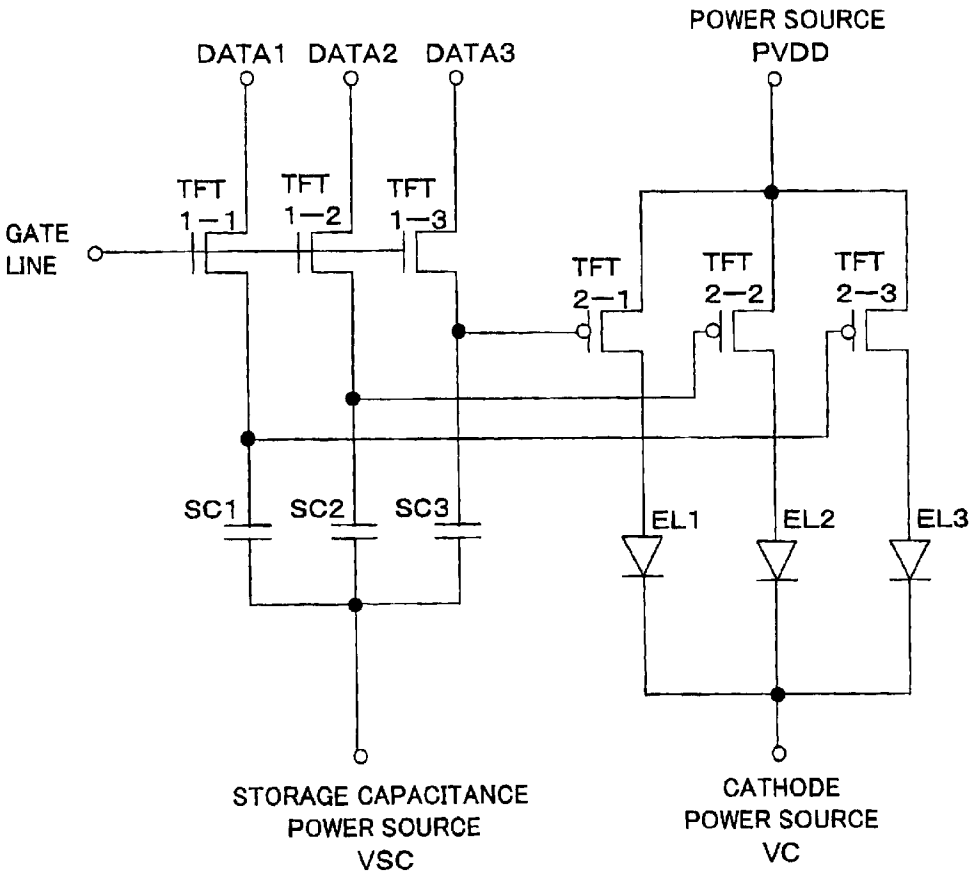
FIG. 1 is a diagram showing a structure according to one embodiment of the present invention.

FIG. 1 is a diagram showing one pixel according to the preferred embodiment of the present invention. The gate line in the horizontal direction is connected to the gates of three n channel scan TFTs 1-1, 1-2, and 1-3. The three scan TFTs 1-1, 1-2, and 1-3 are simultaneously switched on for the duration of one horizontal period when the horizontal line is selected.

The drain of each of the scan TFTs 1-1, 1-2, and 1-3 is respectively connected to a separate data line DATA1, DATA2, and DATA 3. The source of each of the scan TFTs 1-1, 1-2, and 1-3, on the other hand, is respectively connected to a separate storage capacitor SC1, SC2, and SC3. The other terminal of each of the storage capacitors SC1, SC2, and SC3 is connected to a storage capacitance power source line VSC which is a power source line.

The connecting points between the sources of scan TFTs 1-1, 1-2, and 1-3 and the storage capacitors SC1, SC2, and SC3 are respectively connected to the gate of driving TFTs 2-1, 2-2, and 2-3, all of which are p channel TFTs. The sources of the driving TFTs 2-1, 2-2, and 2-3 are all connected to a power source line PVDD and the drains of the driving TFTs 2-1, 2-2, and 2-3 are respectively connected to anodes of separate organic EL elements EL1, EL2, and EL3. The cathodes of the organic EL elements EL1, EL2, and EL3 are connected to a cathode power source. In other words, one pixel is made of three EL elements EL1, EL2, and EL3, each of which forms a sub-pixel.

In such a circuit, the sizes of the driving TFTs 2-1, 2-2, and 2-3 are set at a ratio of 1:2:4. Signals representing the first, second, and third bit in the brightness data are respectively supplied to the data lines DATA1, DATA2, and DATA3. In this manner, an organic EL driving current having 3 bits and corresponding to 8 gray scale data of "000"

to "111" can be obtained. The size of the TFTs 2-1, 2-2 and 2-3 are set by adjusting the gate lengths and/or the gate widths.

With such a configuration, the amount of current can be controlled by varying the size for the driving TFTs 2-1, 2-2, and 2-3, and switching the TFTs fully on. Because the control is an on/off control and the amount of current is approximately constant, the lifetime of the driving TFTs 2-1, 2-2, and 2-3 can be increased. Moreover, because the brightness signal can be supplied to the data lines DATA1, DATA2, and DATA3 as digital data, the brightness data for each pixel obtained by a digital process can be directly supplied to the data lines DATA1, DATA2, and DATA3, and a D/A converter or the like is no longer necessary. Because the data is digital, a significantly lower level of degradation of data through the communication routes can be maintained.

The TFTs 2-1, 2-2, and 2-3 are p channel transistors, and thus, the amount of current is increased as the potential at the gate is lowered. Because, as a result, the brightness is increased as the amount of charges stored in the storage capacitors SC1, SC2, and SC3 is decreased, it is preferable to use inverted brightness data as the data to be supplied to the data lines DATA1, DATA2, and DATA3. The LSB of the brightness data is supplied to the gate of the smallest driving transistor TFT2 and the MSB of the brightness data is supplied to the gate of the largest driving transistor TFT2.

For a color display, pixels are separately provided for R, G, and B, and each of the R, G, and B pixels can be driven by separate video signals.

Figure 2:
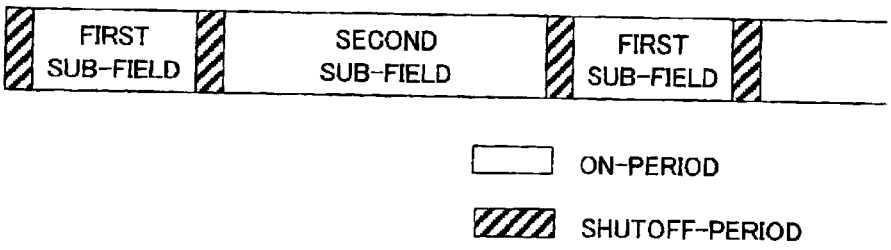
FIG. 2 is a diagram explaining a structure of sub-fields.

Although in the above example the gray scale is controlled by controlling light emission of organic EL elements EL1, EL2, and EL3 each of which has different amount of light emission (amount of drive current) and constitutes a sub-pixel, in addition to this approach, it is also preferable to control the light emission period of each sub-pixel. For example, as shown in FIG. 2, one field may be divided to a first sub-field and a second sub-field. The lengths of the sub-fields may then be set at a ratio of 1:2. In this manner, the control of each organic EL element which was in the above example on and off, or "0" and "1", can be extended to 4 steps, or "0", "1", "2", and "3", depending on time.

For example, time division light emission can be achieved by setting the length of the time period of the first sub-field to 7.5 msec (120 Hz) and the length of the time period of the second sub-field to 15 msec (60 Hz), and providing a predetermined shutout period between each sub-field.

It is also preferable to vary the light emission area for each sub-pixel to control the amount of light emission for each pixel.

Figure 3:
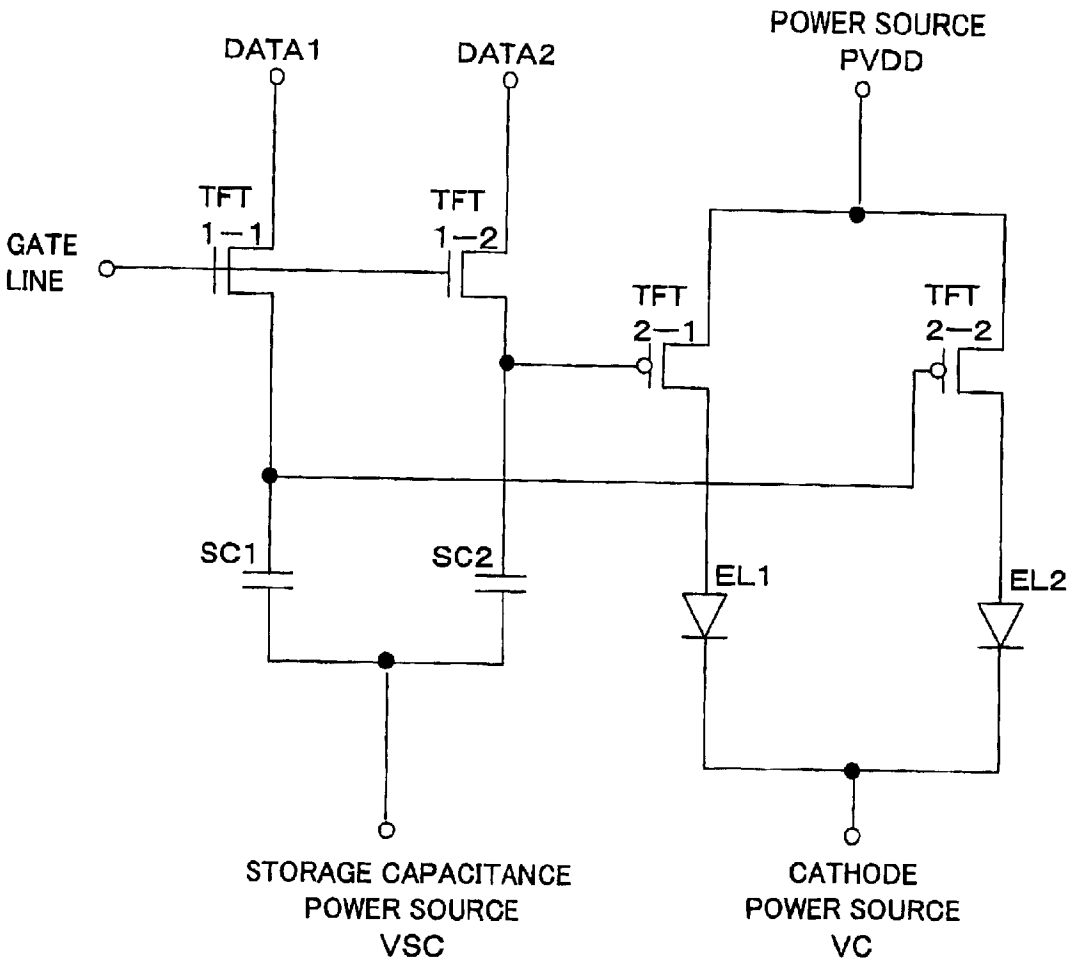
FIG. 3 is a diagram showing a structure according to another embodiment of the present invention.
Figure 6:
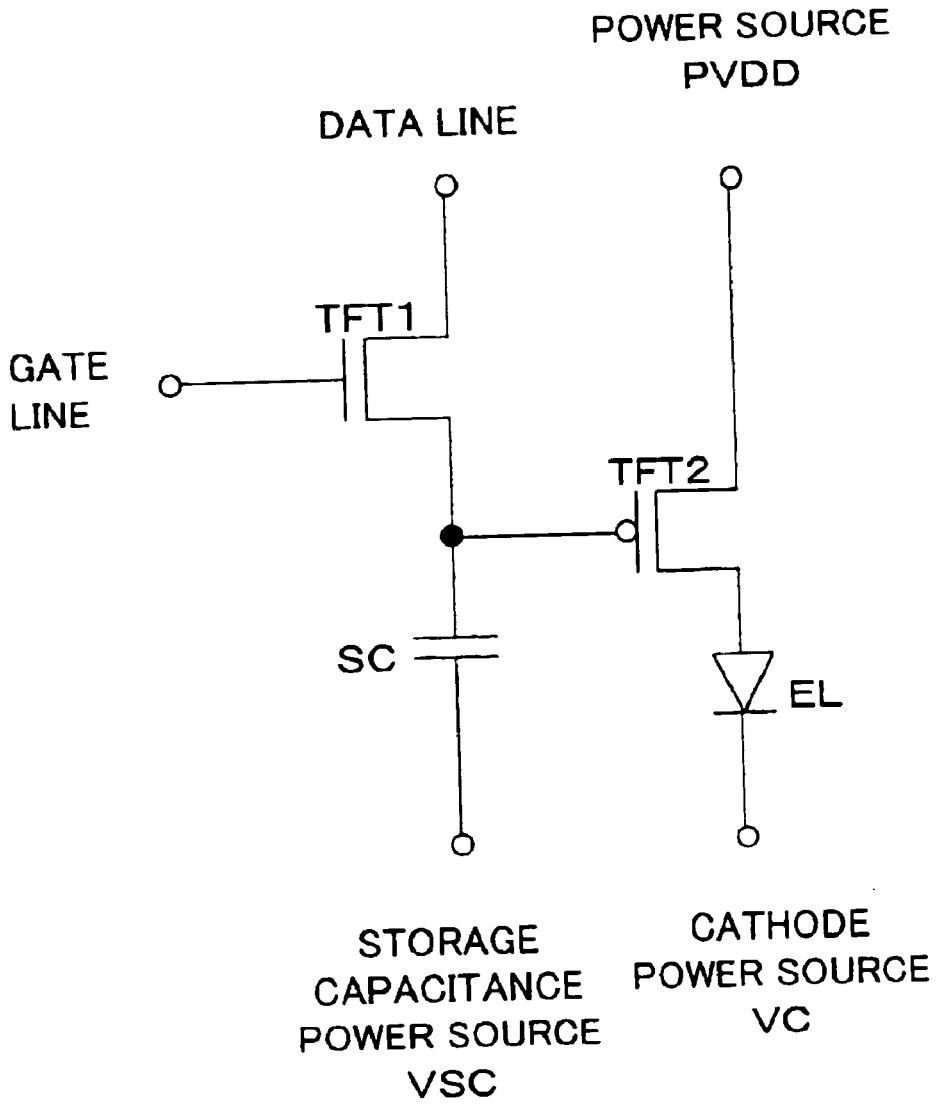
Fig. 6 PRIOR ART
FIG. 6 is a diagram showing a structure of one pixel according to the prior art.

An example of light emission control including time division, current control, and area variation among sub-pixels will next be described. In order to simplify the description, in this example two driving TFT2s 2-1 and 2-2 are provided as shown in FIG. 3. Accordingly, two scan TFT1s, two storage capacitors SC, and two organic EL elements EL are provided.

The sizes of the TFTs 2-1 and 2-2 are set at a ratio of 1:4, while the light emission area ratio of the organic EL elements EL1 and EL2, each of which constitutes a sub-pixel, is set at a ratio of 1:2.

The frequency of the first sub-field is set at twice the frequency of the second sub-field. In this manner, as shown in FIG. 4, for 16 gray scale levels of "0000" to "1111" (gray scale levels of 0 to 15) of the digital data (data signal), the first and second bits can be realized by switching on and off the first sub-pixel respectively in the first sub-field and second sub-field, and the third and fourth bits can be realized by switching on and off the second sub-pixel respectively in the first sub-field and second sub-field.

As shown in FIG. 5, when the frequency of the first sub-field is set at four times the frequency of the second sub-field, for 16 gray scale levels, the first and second bits can be realized by switching on and off the first and second sub-pixels in the first sub-field and the third and fourth bits can be realized by switching on and off the first and second sub-pixels in the second field.

By employing such time division light emission, the number of gray scale levels can be doubled, and, a display with a relatively large number of gray scale levels can be achieved by combining the time division light emission with control of the amount of current as described above.

In the example shown in FIG. 5, the area of the organic El elements EL1 and EL2, each of which constitutes a sub-pixel, are equal, the time ratio of the sub-fields is set at a ratio of 1:4, and the size of the transistors (driving TFTs) is set at a ratio of 1:2.

Instead of setting the size of the driving TFTs at a ratio of 1:4, it is also possible to provide a plurality of driving TFTs of the same size in each pixel, with the number of TFTs being at a ratio of 1:4.

Similarly, instead of setting the light emission area of the EL element at a ratio of 1:4, it is also possible to provide a plurality of EL elements having the same light emission area in each pixel, with the number of TFTs being at a ratio of 1:4.

It should also be noted that the scan TFTs and driving TFTs are not limited to n channel and p channel TFTs as described above.

What is claimed is:

1. An organic electroluminescent circuit comprising:

a plurality of pixels, each pixel having a plurality of driving transistors which are switched on and off based on data from a plurality of data lines and a plurality of organic electroluminescent elements each of which is provided to correspond to each of said plurality of driving transistors, wherein the transistor size of each of said driving transistors differs from that of the other driving transistors;

current provided to a given one of the organic electroluminescent elements is varied in accordance with the size of the corresponding driving transistor connected thereto; and gray scale display is effected by controlling the number of transistors to be switched on in order to vary the number of electroluminescent elements which are switched on in each pixel and thereby control the amount of light emitted by each pixel.

2. An organic electroluminescent circuit according to claim 1, wherein the sizes of the plurality of driving transistors are set so that the sizes are sequentially doubled.

3. An organic electroluminescent circuit according to claim 1, wherein the size of the transistor is determined by the gate length and/or gate width of the transistor.

4. An organic electroluminescent circuit according to claim 1, wherein the driving period of the driving transistor of each pixel is divided into a plurality of sub-fields; and the duration of ON condition of each electroluminescent element is controlled by controlling the onloff condition in each sub-field.

5. An organic electroluminescent circuit according to claim 4, wherein the lengths of said plurality of sub-fields are set so that they are sequentially doubled.

6. An organic electroluminescent circuit according to claim 1, wherein areas of the plurality of organic electroluminescent elements for each pixel are equal to one another.

* * * * *